US007487932B2

(12) United States Patent
Ellis

(10) Patent No.: US 7,487,932 B2
(45) Date of Patent: Feb. 10, 2009

(54) WIRE SPOOL

(76) Inventor: Andrew Ellis, 50 Glen Ave., West Orange, NJ (US) 07052

( * ) Notice: Subject to any disclaimer, the term of this patent is extended or adjusted under 35 U.S.C. 154(b) by 84 days.

(21) Appl. No.: 11/642,324

(22) Filed: Dec. 20, 2006

(65) Prior Publication Data

US 2007/0138330 A1 Jun. 21, 2007

Related U.S. Application Data

(60) Provisional application No. 60/751,821, filed on Dec. 20, 2005.

(51) Int. Cl.
*B65H 19/28* (2006.01)

(52) U.S. Cl. ..... 242/587.2; 242/125.2

(58) Field of Classification Search ..... 242/587, 242/587.2, 125, 125.1, 125.2, 138, 140
See application file for complete search history.

(56) References Cited

U.S. PATENT DOCUMENTS 117,612 A * 8/1871 Dimock ..... 242/125.2
366,073 A * 7/1887 Cate ..... 242/125
1,851,314 A * 3/1932 Knoche ..... 242/125.1
2,374,111 A * 4/1945 Le Tourneau ..... 242/587
2,470,835 A * 5/1949 Paffen et al. ..... 242/125.1
3,358,943 A * 12/1967 Pelson ..... 242/125.2
4,050,646 A * 9/1977 Burchette, Jr. ..... 242/125.1
4,063,696 A * 12/1977 Kelly et al. ..... 242/125.1
4,387,863 A * 6/1983 Edmonston et al. ..... 242/125
D345,048 S * 3/1994 Randolph ..... D3/23
6,779,750 B1 * 8/2004 Couchey et al. ..... 242/125.1
7,240,875 B2 * 7/2007 Hernandez et al. ..... 242/587.2

* cited by examiner

*Primary Examiner*—William A Rivera
(74) *Attorney, Agent, or Firm*—McCarter & English, LLP

(57) ABSTRACT

A spool for gathering and bundling a wire and/or a cable, such as a computer cable, is provided. The spool includes a central portion having a generally cylindrical shape, and could include conical top and bottom portions. Locking slots are provided on the top and bottom portions of the spool and releasably lock a wire and/or a cable on the spool. Retention prongs could be provided on the central portion of the spool for retaining the wire on the spool.

14 Claims, 2 Drawing Sheets

WIRE SPOOL

RELATED APPLICATIONS

The present application claims the benefit of U.S. Provisional Application Ser. No. 60/751,821 filed Dec. 20, 2005, the entire disclosure of which is expressly incorporated herein by reference.

BACKGROUND OF THE INVENTION

1. Field of the Invention

The present invention relates to a method and apparatus for bundling and storing excess wires and/or cables neatly and conveniently on a spool.

2. Related Art

The terms wire and cable are used interchangeably herein to refer to any computer or electrical wire or cable. Wires and cables, such as computer cables, are typically sold in discrete lengths. Often, an excess of wire or cable exists, and this excess wire or cable can quickly become an unsightly and inconvenient mess. There have been efforts in the past to neatly retain wires and cables, but they have been inadequate. One past approach is simply to manipulate a cable itself: part of the cable is folded in vertical loops and bundled together, and then the remainder of the cable is twisted in a helical fashion perpendicularly around the vertical loops and tied in a knot. Another approach is to use a wire tie or a plastic locking strip to encircle a cable which is looped against itself.

These bundling mechanisms have several disadvantages. It is often difficult to properly wrap cables about themselves, and they can easily become unraveled. Similarly, wire ties and plastic locking strips can become useless if loops of the cable are removed. Further, a plastic locking strip may need to be cut to free up wire or cable if additional length is needed.

Accordingly, what would be desirable, but has not yet been provided, is a device for organizing and bundling computer cables and wires which is both easy to use and readily reusable.

SUMMARY OF THE INVENTION

The present invention overcomes the disadvantages and shortcomings of the prior art discussed above by providing spool having a generally cylindrical shape. Generally conical top and bottom portions could be provided. Retention prongs are provided on the central portion of the spool for retaining the wire on the spool. Locking slots are provided on the top and bottom portions of the spool and releasably lock the wire on the spool. The locking slots, retention prongs, and size of the cable spool can be varied to accommodate wire or computer cables of different sizes. In one embodiment, the locking slots are sized and shaped to accommodate a cable of one width/diameter. In another embodiment, two or more sets of locking slots of different dimension are provided to accommodate different widths/diameters of cable either alone or simultaneously wound around the cable spool.

Further features and advantages of the invention will appear more clearly on a reading of the following Detailed Description of the Invention.

BRIEF DESCRIPTION OF THE DRAWINGS

For a more complete understanding of the present invention, reference is made to the following Detailed Description of the Invention considered in conjunction with the accompanying drawings, in which.

DETAILED DESCRIPTION OF THE INVENTION

Figure 1:
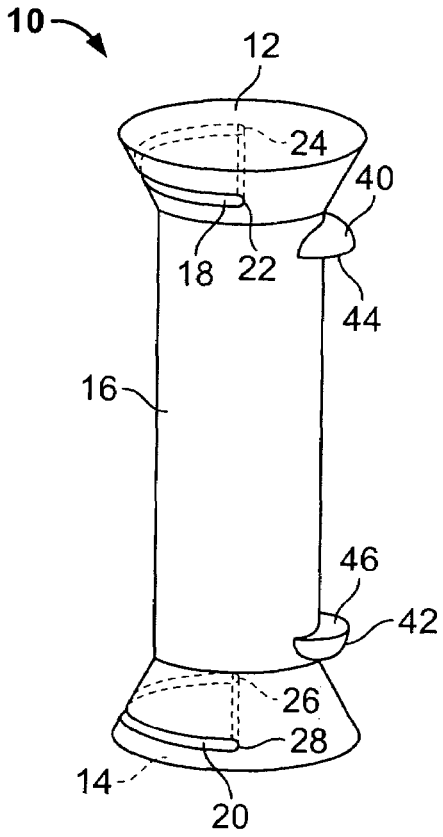
FIG. 1 is a perspective view of a wire and/or cable spool constructed in accordance with the present invention, which includes locking slots and retention prongs.
Figure 2:
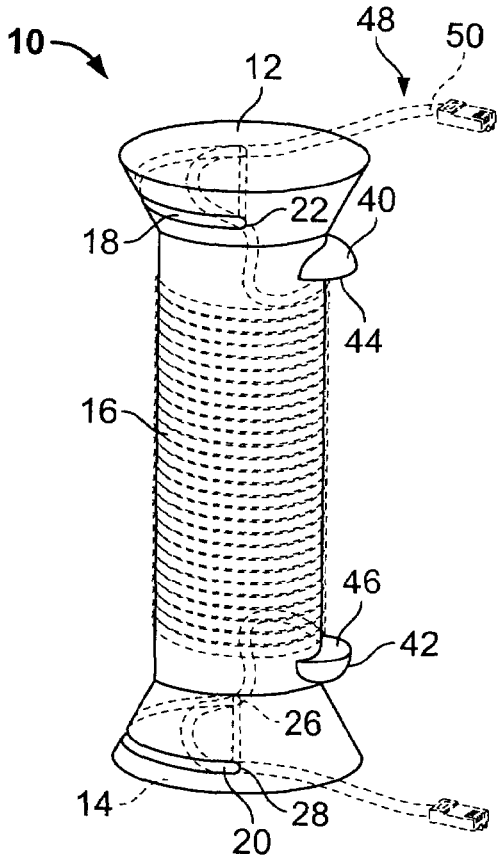
FIG. 2 is a perspective view of the spool of FIG. 1, around which a computer cable or wire has been wrapped and secured in place.

With reference to FIGS. 1-2, there is shown a cable spool 10 constructed in accordance with the present invention. The cable spool 10 is of generally cylindrical shape. The spool 10 has a top portion 12, a bottom portion 14, and a generally cylindrical central portion 16. The top and bottom portions 12 and 14 could flare out in a generally conical shape. The shape of the spool can be varied as desired. The cable spool 10 can come in a variety of sizes and can be made from a variety of materials (e.g. wood, rubber, plastic, etc.), with hard rubber being a preferred material.

Figure 3:
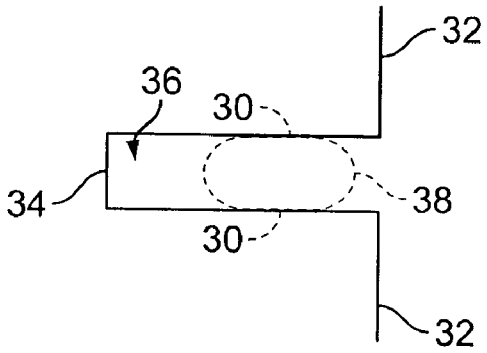
FIG. 3 is a schematic cross-sectional view of a locking slot positioned on the spool shown in FIG. 1.

Locking slots 18, 20 are formed in the top and bottom portions 12, 14, respectively. The locking slots 18, 20 extend a distance through top and bottom portions 12, 14 to ends 22, 24, and 26, 28, respectively. This distance could be, for example, half way through the top and bottom portions. Referring now to FIG. 3, the cross-sectional shape of the locking slots 18, 20 include sidewalls 30 which extend from a front surface 32 of the top and bottom portions 12, 14 to a back surface 34. The sidewalls 30 and back surface 34 coincides with a pair of ends 22, 24, or 26, 28, respectively, to define an interior 36 of one of the locking slots 18, 20. The interior 36 can be sized and shaped such that the sidewalls 30 provide a friction fit with a wire 38 and the back surface 34 provides a resting barrier to the wire 38. The side walls 30 can be positioned at angles with respect to each other so that the locking slot tapers from the open end to the back surface 34. The wire 38 is releasably locked in the locking slots 18, 20. The side walls 30 of the locking slots 18, 20 have some give, i.e., the spool is made of material that has some flexibility, so that when the wire 38 is pushed into in the locking slots 18, 20, it is frictionally retained in the locking slots 18, 20 part way between the front surface 32 and the back surface 34. In a preferred embodiment, a spool 10 having locking slots 18, 20 with a recess height between surfaces 30, 30 of about 3/16 inch would accommodate a standard computer cable having about a ¼ inch diameter, while a recess height of about 3/32 inch width would accommodate standard computer cables having a diameter of ⅛ inch. The sizes of the locking slots 18, 20 can be varied in accordance with the size of cable or wire it is desired to be used with.

Referring to FIGS. 1-2, retention prongs 40, 42 extend from the spool 10 at the junction between the central portion 16 and the top and bottom portions 12, 14, respectively. Two prongs are shown, one at an upper location and another at a lower location, but more could be used, e.g., two or more could be positioned at the upper and lower locations. The retention prongs 40, 42 retain the coil of wire on the spool and accordingly, could be slightly curved, with concave inner surfaces 44, 46, respectively, for retaining cables on the spool 10. The locking slots 18, 20 are positioned on the top and bottom portions 12, 14 of the spool 10, respectively.

With reference to FIG. 2, in operation, one end 48 of a computer cable 50 is fed into the locking slot 18 and then wrapped over the surface of the central portion 16 between retention prongs 40, 42, and then it is engaged by the other locking slot 20. Pressure is applied to computer cable 50 until it "locks" within the interior 36 of the locking slots 18, 20. This allows excess wire to be rolled onto the spool 10 and releasably locked thereon.

Figure 4:
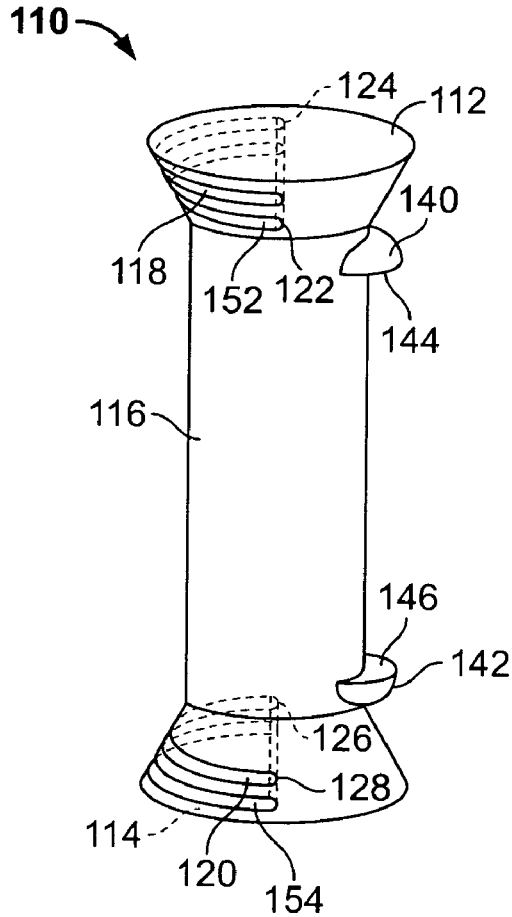
FIG. 4 is a perspective view of a wire and/or cable spool constructed in accordance with another embodiment of the present invention, which includes two different-sized locking slots.

FIG. 4 illustrates another embodiment of the present invention. Elements illustrated in FIG. 4, which correspond, either identically or substantially, to the elements described above with respect to FIGS. 1-3, have been designated by corresponding reference numerals increased by one hundred. Unless otherwise stated, the device shown in FIG. 4 is constructed and assembled and operates in the same basic manner as that shown FIGS. 1-3.

The cable spool 110 has a second pair of locking slots 152, 154. The second pair of locking slots 152, 154 have widths (here shown as smaller) different from the widths of the locking slots 118, 120. A second computer cable (not shown) of width similar to the locking slots 152, 154 can be wrapped around the wire spool 110 and locked in place in the locking slots 118, 120. In other embodiments, the wire spool 110 can have any number of locking slots for accommodating computer cables of different diameters.

The wire spools 10, 110 of the present invention have several advantages over prior art computer cable securing methods. The locking slots 118, 120, 152, 154 and the retention prongs 140, 142 prevent a computer cable from unraveling. Wrapping a computer cable around the wire spools 10, 110 is easier and less time consuming than wrapping the computer cable about itself. The locking slots 118, 120, 152, 154 and the retention prongs 140, 142 prevent a computer cable from unraveling. The spools 10, 110 are completely reusable, unlike wire ties or plastic strips. Further, the spools 10, 110 are easy and inexpensive to manufacture.

It will be understood that the embodiments described herein are merely exemplary and that a person skilled in the art may make many variations and modifications without departing from the spirit and scope of the invention. All such variations and modifications are intended to be included within the scope of the invention. What is desired to be protected by Letters Patent is set forth in the following claims.

What is claimed is:

1. A spool for bundling a cable, comprising:

a central portion having top and bottom portions attached thereto;

first and second retention prongs positioned on the central portion for retaining a wire in position about the central portion;

a first locking slot formed in the top portion; and a second locking slot formed in the bottom portion, wherein a cable can be wrapped about the central portion and the first and second locking slots releasably lock the cable in position about the central portion of the spool.

2. The spool of claim 1, wherein the central portion is generally cylindrical in shape.

3. The spool of claim 2, wherein the top and bottom portions are generally conical in shape.

4. The spool of claim 1, wherein the first and second locking slots frictionally engage a cable.

5. The spool of claim 4, wherein the slots taper from an open end to a back end.

6. The spool of claim 4, wherein the locking slots flex to accommodate a cable.

7. The spool of claim 1, wherein each of the retention prongs include a concave inner surface.

8. The spool of claim 1, further comprising a third locking slot formed in the top portion, the first and third locking slots having different widths.

9. The spool of claim 8, further comprising a fourth locking slot formed in the bottom portion, the second and fourth locking slots having different widths.

10. The spool of claim 9, wherein the third and fourth locking slots frictionally engage a cable.

11. A method for bundling a cable, comprising:

inserting a first portion of a cable into a first locking slot formed in a spool;

wrapping the cable about a central portion of the spool between first and second retention prongs formed on the spool; and inserting a second portion of the cable into a second locking slot formed in the spool, the first and second locking slots co-acting to retain the wire cable in position about the central portion of the spool.

12. The method of claim 11, further comprising:

gathering excess cable;

wrapping the excess cable about the spool; and capturing the cable leaving the spool on both sides in the locking slots.

13. The method of claim 12, further comprising freeing up excess cable by removing one side from the locking slot, unwinding a desired amount of cable, and capturing the cable leaving the spool in the locking slot.

14. A spool for bundling a cable, comprising:

a central portion having top and bottom portions attached thereto;

first and second retention prongs positioned on the central portion for retaining a wire in position about the central portion;

a first locking slot formed in the top portion;

a second locking slot formed in the bottom portion;

a third locking slot formed in the top portion, the first and third locking slots having different widths; and fourth locking slot formed in the bottom portion, the second and fourth locking slots having different widths.

wherein a cable can be wrapped about the central portion and the first and second or third and fourth locking slots releasably lock the cable in position about the central portion of the spool.

* * * * *

UNITED STATES PATENT AND TRADEMARK OFFICE

CERTIFICATE OF CORRECTION

PATENT NO. : 7,487,932 B2
APPLICATION NO. : 11/642324
DATED : February 10, 2009
INVENTOR(S) : Andrew Ellis It is certified that error appears in the above-identified patent and that said Letters Patent is hereby corrected as shown below:

Column 4, line 29, the word "wire" should be deleted.

Signed and Sealed this

Twenty-first Day of April, 2009

JOHN DOLL
*Acting Director of the United States Patent and Trademark Office*